US009732461B2

(12) United States Patent
Lee et al.

(10) Patent No.: US 9,732,461 B2
(45) Date of Patent: Aug. 15, 2017

(54) DETERGENT MIXER AND WASHING MACHINE INCLUDING THE SAME

(71) Applicant: LG ELECTRONICS INC., Seoul (KR)

(72) Inventors: Dongsoo Lee, Seoul (KR); Jaehyuk Jang, Seoul (KR); Youngho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 421 days.

(21) Appl. No.: 14/051,110

(22) Filed: Oct. 10, 2013

(65) Prior Publication Data

US 2014/0102153 A1 Apr. 17, 2014

(30) Foreign Application Priority Data

Oct. 12, 2012 (KR) ..... 10-2012-0113721

(51) Int. Cl.
*D06F 39/02* (2006.01)

(52) U.S. Cl.
CPC ..... *D06F 39/022* (2013.01)

(58) Field of Classification Search
CPC ..... D06F 39/022
USPC ..... 68/17 R
See application file for complete search history.

(56) References Cited

U.S. PATENT DOCUMENTS

| | | | | |
|---|---|---|---|---|
| 2,540,064 | A * | 1/1951 | Weber | 137/888 |
| 4,503,575 | A | 3/1985 | Knoop et al. | |
| 6,349,440 | B1 | 2/2002 | Amberg et al. | |
| 2010/0018991 | A1 * | 1/2010 | Walker et al. | 222/52 |

FOREIGN PATENT DOCUMENTS

| | | | |
|---|---|---|---|
| CN | 1508346 | A | 6/2004 |
| CN | 1779045 | A | 5/2006 |
| JP | 2009-56264 | A | 3/2009 |
| JP | 2009-178195 | A | 8/2009 |
| WO | 2006/094219 | A2 | 9/2006 |

* cited by examiner

*Primary Examiner* — Michael Barr
*Assistant Examiner* — Rita Adhlakha
(74) *Attorney, Agent, or Firm* — Dentons US LLP

(57) ABSTRACT

A liquid detergent mixer includes a main body, a detergent inlet pipe, a wash water inlet pipe, and a wash water dispersing unit. The main body defines a mixing space in which wash water and liquid detergent are mixed. The detergent inlet pipe allows liquid detergent to flow into the mixing space. The wash water inlet pipe has one end protruding from the other side surface of the main body to the mixing space to allow wash water to flow into the mixing space.

14 Claims, 7 Drawing Sheets

DETERGENT MIXER AND WASHING MACHINE INCLUDING THE SAME

This application claims priority benefit of Korean Patent Application No. 10-2012-0113721 filed on Oct. 12, 2012 in the Korean Intellectual Property Office, the disclosure of which is incorporated herein by reference in its entirety.

BACKGROUND

1. Field

The present disclosure relates to a liquid detergent mixer and a washing machine including the liquid detergent mixer, and more particularly, to a liquid detergent mixer and a washing machine including the liquid detergent mixer, which can efficiently mix liquid detergent and wash water.

2. Description of the Related Art

Generally, a washing machine is an apparatus that performs wash, rinse, and spin cycles to remove contaminants from clothing and bedding (hereinafter, referred to as 'laundry') using water, detergent, and mechanical action.

The washing machine includes a washing tub rotatably disposed therein for holding water and laundry. The rotation of the washing tub by a driving unit enables the washing of laundry. Also, the washing machine further includes a water supply unit for supplying water into the washing tub and a water discharge unit for discharging water out of the washing tub. A detergent supply unit is disposed on a water supply path of the water supply unit to supply detergent into the washing tub.

In case of commercial washing machines, the detergent supply unit is supplied with liquid detergent from a liquid detergent box disposed outside the washing machine, and then mixes the liquid detergent with the wash water to supply the mixture to the washing tub. In this case, it is necessary to efficiently mix wash water and liquid detergent.

SUMMARY

One object of the present disclosure is to provide a liquid detergent mixer and a washing machine including the liquid detergent mixer, which can efficiently mix liquid detergent and wash water.

Another object of the present disclosure is to provide a liquid detergent mixer and a washing machine including the liquid detergent mixer, in which wash water is dispersed and mixed with liquid detergent.

Objects of the present disclosure are not limited to the above. Other objects will be clearly understood by the persons skilled in the art from the following description.

According to one embodiment of the present invention, there is provided a washing machine comprising: a tub; a water supply valve to control an inflow of wash water; a liquid detergent supply unit to supply liquid detergent; and a liquid detergent mixing unit connected to the water supply valve to receive wash water and connected to the liquid detergent supply unit to receive liquid detergent, the wash water and the liquid detergent being mixed and guided to the tub, wherein the liquid detergent mixing unit comprises: a main body defining a mixing space in which the wash water and the liquid detergent are mixed; a detergent inlet pipe connected to the liquid detergent supply unit to guide liquid detergent into the main body; a wash water inlet pipe connected to the water supply valve and having one end protruding from the other side surface of the main body to the mixing space to guide wash water to the mixing space; and a wash water dispersing unit protruding from an opposite side surface to the one side surface of the main body into the mixing space to contact the one end of the wash water inlet pipe.

According to another embodiment of the present invention, there is provided a liquid detergent mixer, comprising: a main body defining a mixing space in which wash water and liquid detergent are mixed; a detergent inlet pipe to allow liquid detergent to flow into the mixing space; a wash water inlet pipe disposed on one side surface opposite to the one side surface of the main body and having one end protruding from the one side surface of the main body to the mixing space to allow wash water to flow into the mixing space; and a wash water dispersing unit protruding from an opposite side surface to the one side surface of the main body into the mixing space to contact the one end of the wash water inlet pipe.

The foregoing and other objects, features, aspects, and advantages will become more apparent from the following detailed description of embodiments of the present invention when taken in conjunction with the accompanying drawings.

DETAILED DESCRIPTION

Figure 1:
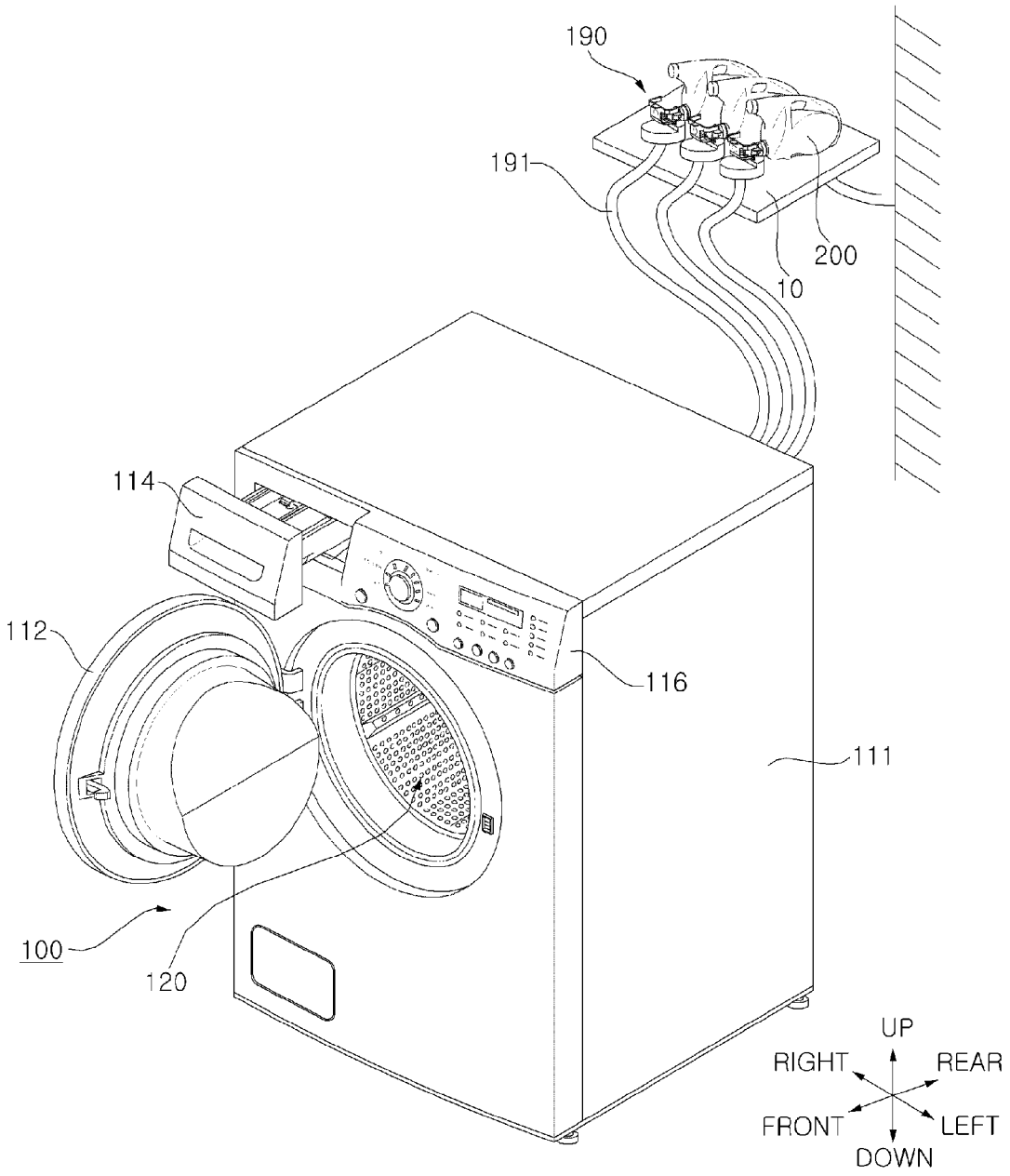
FIG. 1 is a perspective view illustrating a washing machine according to an embodiment of the present invention.

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Hereinafter, exemplary embodiments of liquid detergent mixers and washing machines including the liquid detergent mixers will be described in detail with reference to the accompanying drawings.

Figure 2:
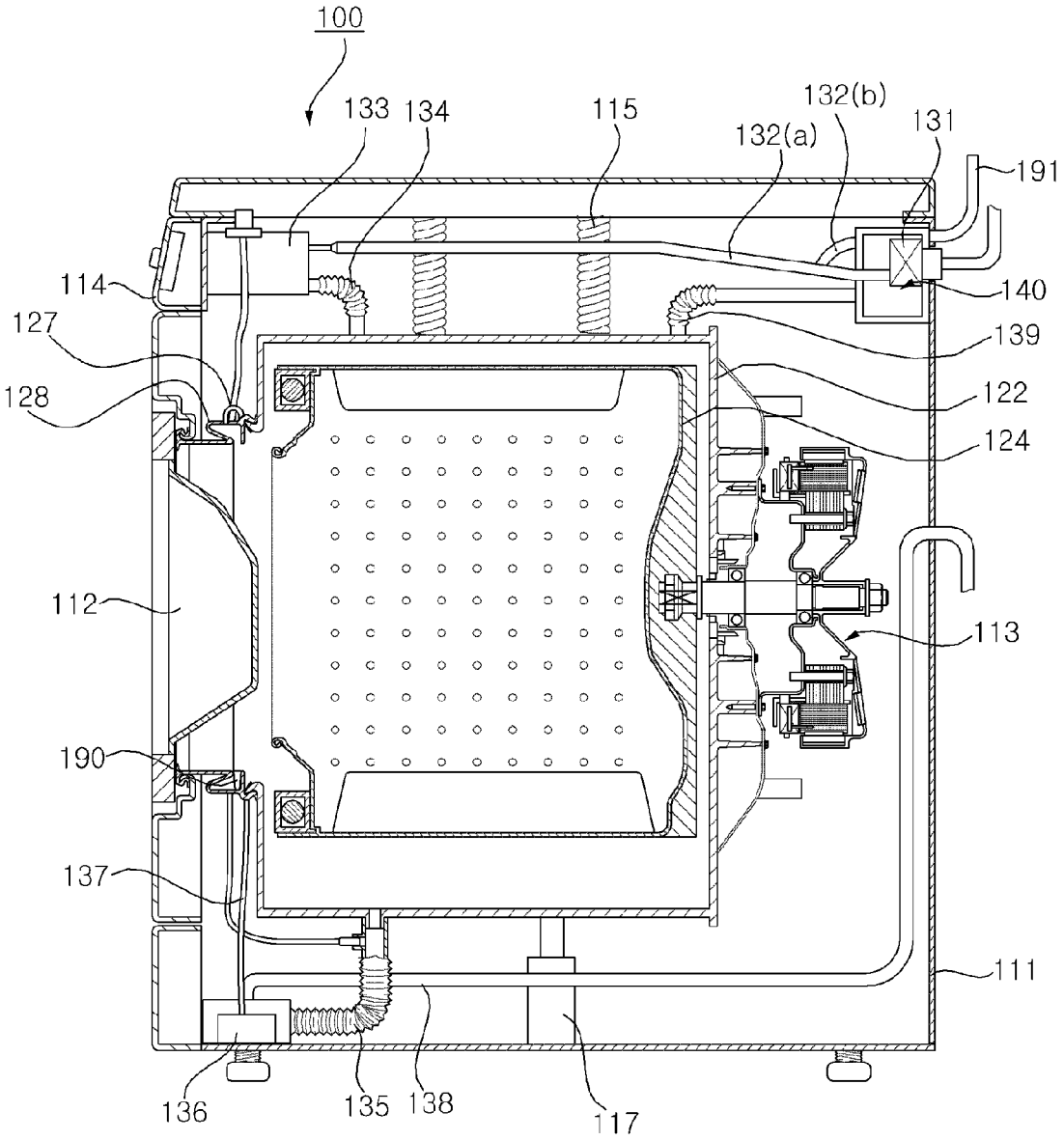
FIG. 2 is a cross-sectional view of the washing machine shown in FIG. 1.
Figure 3:
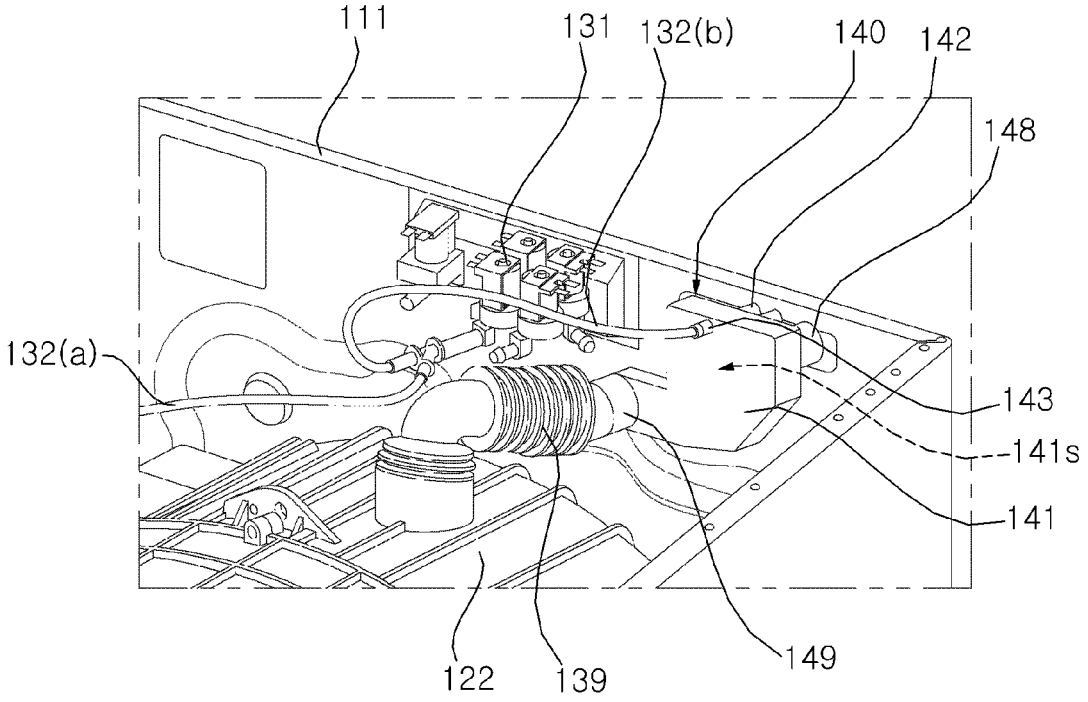
FIG. 3 is a view illustrating a partial structure of the washing machine shown in FIG. 1.

FIG. 1 is a perspective view illustrating a washing machine according to an embodiment of the present invention. FIG. 2 is a cross-sectional view of the washing machine shown in FIG. 1. FIG. 3 is a view illustrating a partial structure of the washing machine shown in FIG. 1.

A washing machine 100 according to an embodiment of the present invention may include a cabinet 111, a door 112, a tub 122, a drum 124, a water supply valve 131, a liquid detergent supply unit 190, a liquid detergent mixing unit 140. The cabinet 111 may define the exterior of the washing machine 100. The door 112 may open and close one side of the cabinet 111 to load laundry into the cabinet 111. The tub 122 may be disposed inside the cabinet 111 to hold wash water. The drum 124 may be disposed inside the tub 122 to hold laundry and rotate. The water supply valve 131 may control the inflow of wash water from an external water source. The liquid detergent supply unit 190 may supply liquid detergent. The liquid detergent mixing unit 140 may be connected to the water supply valve 131 to receive wash water and may be connected to the liquid detergent supply unit 190 to receive liquid detergent. The liquid detergent mixing unit 140 may mix wash water and liquid detergent that are introduced, and then may guide the mixture to the tub 122.

The cabinet 111 may have a laundry loading hole 120 having a circular shape to take laundry into the drum 124. The door 112 may be pivotably coupled to the cabinet 111 to open and close the laundry loading hole 120. The cabinet 111 may be provided with a control panel 116. A detergent box 114 may be withdrawably disposed in the cabinet 111.

The tub 122 may be disposed in the cabinet 111 so as to be buffered by a spring 115 and a damper 117. The tub 122 may have a cylindrical shape and receive wash water. The tub 122 may have a circular inlet corresponding to the laundry loading hole 120 of the cabinet 111 to load laundry into the drum 124. The drum 124 may be disposed inside the tub 122.

The drum 124 may rotate while being loaded with laundry. The drum 124 may have a plurality of through holes to pass wash water. A lifter (not shown) may be disposed on the inner wall of the drum 124 to lift laundry to a certain height during the rotation of the drum 124. The drum 124 may be rotated by a torque of a motor 113.

The motor 113 may rotate the drum 124. The motor 113 may rotate the drum 124 at different speeds and directions. The motor 113 may include a stator (not shown) wound with a coil and a rotor (not shown) rotating by generating an electromagnetic interaction with the coil.

The detergent box 114 may hold detergent such as laundry detergent, fabric softener, or bleach. The detergent box 114 may be withdrawably disposed at the front surface of the cabinet 111. Detergent in the detergent box 114 may be mixed with wash water, and then may be introduced into the tub 122. In an embodiment, the detergent box 114 may not be provided.

A water supply valve 131, a first water supply passage 132*a*, and a first water supply pipe 134 may be provided in the cabinet 111. The water supply valve 131 may control the inflow of wash water from an external water source. The first water supply passage 132*a* may allow wash water introduced into the water supply valve 131 to flow into the detergent box 114. The first water supply pipe 134 may allow wash water mixed with detergent in the detergent box 114 to flow into the tub 122.

Also, a first water supply passage 132*b* and a second water supply pipe 139 may be further provided in the cabinet 111. The second water supply passage 132*b* may allow wash water introduced into the water supply valve 131 to flow into the liquid detergent mixing unit 140. The second water supply pipe 139 may allow wash water mixed with liquid detergent at the liquid detergent supply unit 190 to flow into the tub 122.

The liquid detergent supply unit 190 may be connected to a liquid detergent box 200 disposed outside the cabinet 111 to supply liquid detergent stored in the liquid detergent box 200 into the liquid detergent mixing unit 140. The liquid detergent supply unit 190 may be disposed outside or inside the cabinet 111. The liquid detergent supply unit 190 may include a liquid detergent pump (not shown) to transfer liquid detergent of the liquid detergent box 200 to the liquid detergent mixing unit 140. The liquid detergent supply unit 190 may include a detergent flowing pipe 191 connected to the liquid detergent mixing unit 140. The liquid detergent supply unit 190 may be disposed in plurality according to the number of the liquid detergent boxes 200, and the detergent flowing pipe 191 may also be disposed in plurality.

The liquid detergent mixing unit 140 may include a main body 141, a detergent inlet pipe 142, a wash water inlet pipe 143, a wash water outlet pipe 149, and a vent pipe 148. The main body 141 may define a mixing space 141*s* in which wash water and liquid detergent are mixed. The detergent inlet pipe 142 may be connected to the liquid detergent supply unit 190 to guide liquid detergent into the main body 141. The wash water inlet pipe 143 may be disposed on one side surface of the main body 141, and may be connected to the water supply valve 131 to guide wash water into the main body 141. The wash water outlet pipe 149 may be disposed at the lower portion of the main body 141 to be connected to the tub 122. The vent pipe 148 may be disposed on one surface of the main body 141 to discharge air out of the mixing space 141*s*.

The main body 141 may form the mixing space 141*s* in which wash water and liquid detergent are mixed. The main body 141 may be disposed at an upper portion of the cabinet 111. The detergent inlet pipe 142 and the vent pipe 148 may be disposed on an opposite side surface to the one side surface of the main body 141, and the wash water inlet pipe 143 may be disposed on the one side surface of the main body 141. The wash water outlet pipe 149 may be disposed at a lower portion of the main body 141. The opposite side surface of the main body 141 may be disposed toward the outside of the cabinet 111, and the one side surface of the main body 141 may be disposed toward the inside of the cabinet 111.

The detergent inlet pipe 142 may be connected to the detergent flowing pipe 191 of the liquid detergent supply unit 190 to receive liquid detergent. The detergent inlet pipe 142 may be disposed at the opposite side surface of the main body 141. The detergent inlet pipe 142 may be disposed in plurality corresponding to a plurality of detergent flowing pipes 191.

The wash water inlet pipe 143 may be connected to the second water supply passage 132*b* to receive wash water from an external water source. The wash water inlet pipe 143 may be disposed at the one side surface of the main body 141. The wash water inlet pipe 143 may be configured to disperse wash water into the mixing space 141*s* of the main body 141.

The wash water outlet pipe 149 may be disposed at a lower portion of the main body to discharge wash water mixed with liquid detergent. The wash water outlet pipe 149 may be connected to the second water supply pipe to guide wash water mixed with liquid detergent to the tub 122. A portion of the undersurface of the main body may be inclined such that wash water mixed with liquid detergent is discharged.

The vent pipe may communicate between the outside of the cabinet 111 and the mixing space 141*s* of the main body 141. The vent pipe 148 may be disposed at the opposite side surface of the main body 141. The vent pipe 148 may allow the tub 122 to exchange air with the outside when the door 112 is closed.

The cabinet 111 may include a drain pipe 135 for discharging wash water out of the tub 122, a pump 136 for discharging wash water out of the tub 122, a circulation flow passage 137 for circulating wash water, a circulation nozzle 127 for allowing wash water to flow into the drum 124, and a drain flow passage 138 for allowing wash water to be discharged to the outside. In an embodiment, the pump 136 may include a circulation pump and a drain pump to be connected to the circulation flow passage 137 and the drain flow passage 138, respectively.

The control panel 116 may receive various operating commands such as washing course selection and operation time and reservation for each cycle from a user, and may display the operation state of the washing machine 100.

The washing course may include, in addition to a normal course, various courses according to the type or function of laundry, such as a lingerie/wool course, a steam course, a quick wash course, a functional garment course, and a silent course. The operations of the washing machine may be divided into a wash cycle, a rinse cycle, and a spin cycle, and in each cycle, supplying water, washing, rinsing, draining, spinning, and/or drying may be performed.

Figure 4:
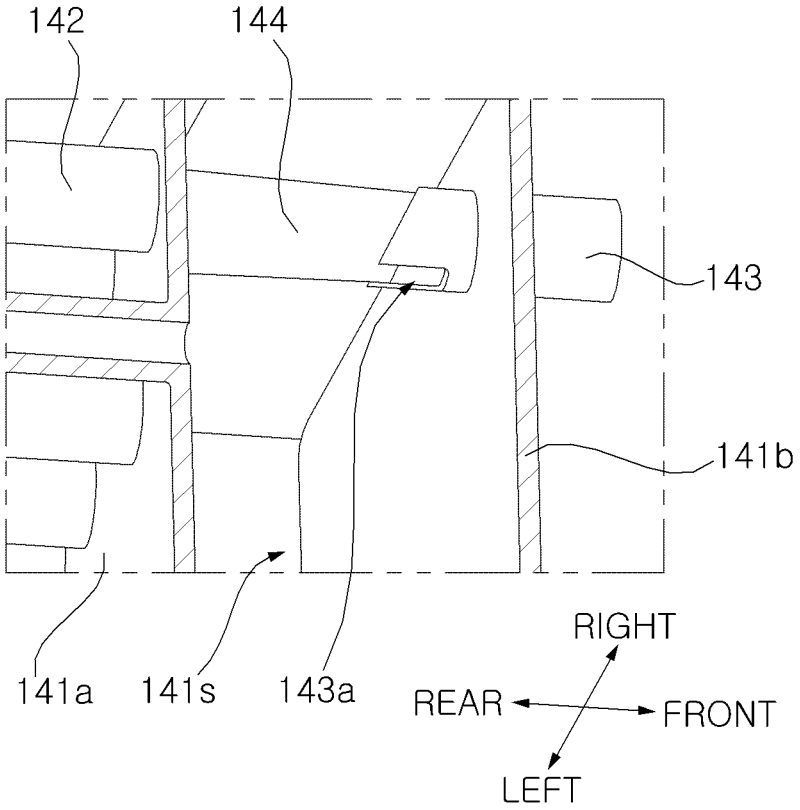
FIG. 4 is a view illustrating a partial structure of a liquid detergent mixer according to an embodiment of the present invention.
Figure 5:
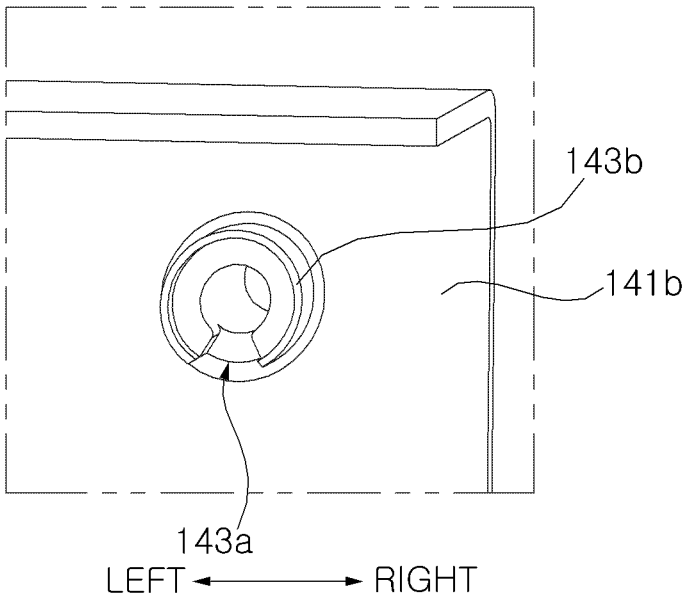
FIG. 5 is a view illustrating a partial structure of a wash water inlet pipe of the liquid detergent mixer shown in FIG. 4.
Figure 6:
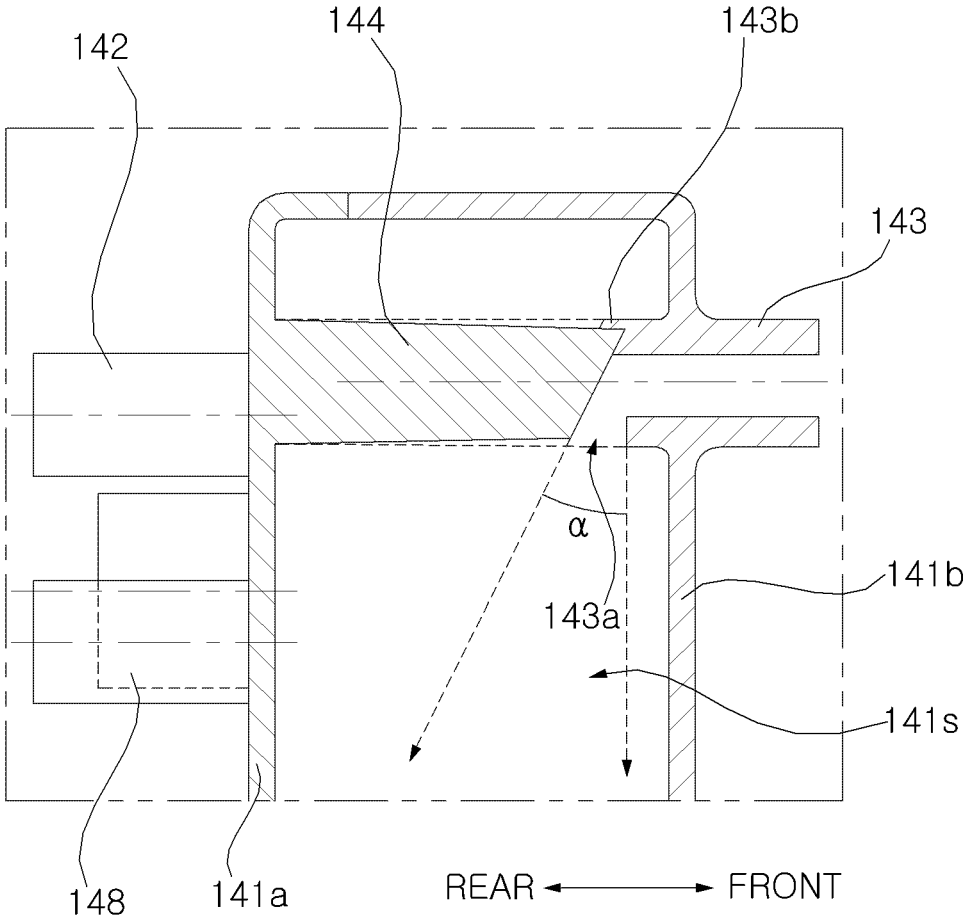
FIG. 6 is a cross-sectional view illustrating a portion of the liquid detergent mixer shown in FIG. 4.

FIG. 4 is a view illustrating a partial structure of a liquid detergent mixer according to one embodiment of the present invention. FIG. 5 is a view illustrating a partial structure of a wash water inlet pipe of the liquid detergent mixer shown in FIG. 4. FIG. 6 is a cross-sectional view illustrating a portion of the liquid detergent mixer shown in FIG. 4.

The liquid detergent mixing unit 140 may include a first body 141*a* forming the opposite side surface of the main body 141 and a second body 141*b* forming the one side surface of the main body 141. The detergent inlet pipe 142 and the vent pipe 148 may be disposed on the first body 141*a*, and the wash water inlet pipe 143 and the wash water outlet pipe 149 may be disposed on the second body 141*b*. The first body 141*a* and the second body 141*b* may be coupled to each other to form the mixing space 141*s*. The first body 141*a* and the second body 141*b* may be formed of synthetic resin to be fused together.

One end of the wash water inlet pipe 143 may protrude from the second body 141*b* of the main body 141 to the mixing space 141*s*. The other end of the wash water inlet pipe 143 may protrude from the second body 141*b* of the main body 141 to the outside to be connected to the second water supply flow passage 132*b*, and the one end of the wash water inlet pipe 143 may protrude into the mixing space 141*s*, allowing wash water to flow into the mixing space 141*s*.

A nozzle 143*a* may be formed at a lower side of the one end of the wash water inlet pipe 143 protruding into the mixing space 141*s* to allow wash water to flow into the mixing space 141*s*. As shown in FIG. 5, the nozzle 143*a* may be radially formed with respect to a plane perpendicular to the flowing direction of wash water. The nozzle 143*a* may be radially formed to allow wash water to be dispersed in a horizontal direction.

The liquid detergent mixing unit 140 may further include a wash water dispersing unit 144 that protrudes from the first body 141*a* of the main body to the mixing space 141*s* to contact one end of the wash water inlet pipe 143.

The wash water dispersing unit 144 may be formed to have a cylindrical shape that protrudes from the first body 141*a* of the main body 141 to the mixing space 141*s*. The wash water dispersing unit 144 may contact one end of the wash water inlet pipe 143 to allow wash water to be dispersed in a downward direction through the nozzle 143*a*. The end surface of the wash water dispersing unit 144 contacting one end of the wash water inlet pipe 143 may be inclined. The end surface of the one end of the wash water inlet pipe 143 may incline corresponding to the end surface of the wash water dispersing unit. Wash water flowing into the wash water inlet pipe 143 may flow into the nozzle 143*a* through the inclined end surface of the wash water dispersing unit 144.

As shown in FIG. 6, since the end surface of wash water dispersing unit 144 inclines, wash water can be dispersed in forward and backward directions. The end surface of the wash water dispersing unit 144 may be obliquely formed such that wash water dispersed from the nozzle 143*a* does not flow into the detergent inlet pipe 142 and/or the vent pipe 148 formed in the first body 141*a* of the main body 141.

The end surface of the wash water dispersing unit 144 may have a dispersing angle $\alpha$ that is an acute angle with respect to a direction perpendicular to the flowing direction of wash water into the wash water inlet pipe 143. The dispersing angle $\alpha$ may be set such that wash water dispersed from the nozzle 143*a* is not directed to the detergent inlet pipe 142 and/or the vent pipe 148 formed in the first body 141*a* of the main body 141.

The center of the detergent inlet pipe 142 may be disposed under the center of the wash water inlet pipe 143, and the center of the vent pipe 148 may be disposed under the center of the wash water inlet pipe 143.

One end of the wash water inlet pipe 143 may have a protrusion part 143*b*, the circumference of which protrudes except a portion where the nozzle 143*a* is formed so as to surround a portion of the circumference of the wash water dispersing unit 144. The protrusion part 143*b* of the wash water inlet pipe 143 may be formed to surround a portion of the circumference of the end surface of the wash water dispersing unit 144. The protrusion part 143*b* of the wash water inlet pipe 143 may not be formed at a portion where the nozzle 143*a* is formed.

The end surface cross-section of the wash water dispersing unit 144 may decrease towards the wash water inlet pipe 143 such that the end surface of the wash water dispersing unit 144 can fit into the protrusion part 143*b* of the wash water inlet pipe 143. That is, the wash water dispersing unit 144 may be tapered.

Figure 7:
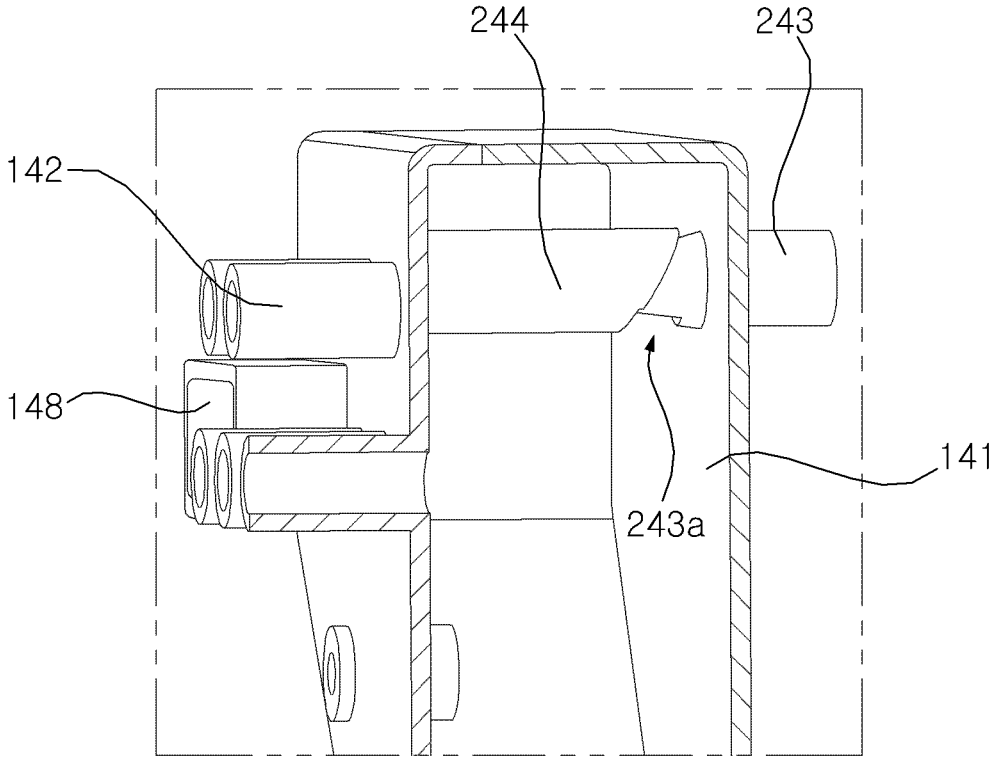
FIG. 7 is a cross-sectional view illustrating a portion of a liquid detergent mixer according to another embodiment of the present invention.

FIG. 7 is a cross-sectional view illustrating a portion of a liquid detergent mixer according to yet another embodiment of the present invention.

A wash water dispersing unit 244 according to another embodiment of the present invention may have an end surface contacting one end of a wash water inlet pipe 243. The circumference of the end surface of the wash water dispersing unit 244 may protrude except a portion where a nozzle 243*a* is formed. A portion of the circumference of the wash water dispersing unit 244 may protrude to surround a portion of the circumference of one end of the wash water inlet pipe 243.

The cross-section of one end of the wash water inlet pipe 243 may decrease towards the wash water dispersing unit 244. That is, the one end of the wash water inlet pipe 243 may be tapered.

While this invention has been shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

According to the embodiments of the present invention, the liquid detergent mixer and the washing machine including the liquid detergent mixer have at least one of the following effects.

First, wash water can be efficiently mixed with liquid detergent while being dispersed.

Second, the structure of dispersing wash water can be efficiently designed, improving the characteristics of assembly.

Third, the liquid detergent mixer and the vent pipe are provided, allowing the tub to exchange air with the outside.

The effects of the present invention are not limited to the above; other effects that are not described herein will be clearly understood by the persons skilled in the art from the following claims.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

a tub;

a water supply valve to control an inflow of wash water;

a liquid detergent supply unit to supply liquid detergent; and a liquid detergent mixing unit connected to the water supply valve to receive wash water and connected to the liquid detergent supply unit to receive liquid detergent, the wash water and the liquid detergent being mixed and guided to the tub, wherein the liquid detergent mixing unit comprises:

a main body defining a mixing space in which the wash water and the liquid detergent are mixed;

a detergent inlet pipe disposed on one side surface of the main body and connected to the liquid detergent supply unit to guide liquid detergent into the main body;

a wash water inlet pipe disposed on an opposite side surface of the main body, wherein the opposite side surface is opposite to the one side surface of the main body, connected to the water supply valve and having one end protruding from the opposite side surface of the main body to the mixing space to guide wash water to the mixing space, and having a nozzle at a lower side of the one end thereof to allow wash water to flow into the mixing space; and a wash water dispersing unit disposed in the mixing space and having one end protruding from the one side surface of the main body and an other end contacted with the one end of the wash water inlet pipe in the mixing space to allow wash water to be dispersed in a downward direction through the nozzle, wherein an outlet of the wash water dispersing unit is opposite to an outlet of the detergent inlet pipe.

2. The washing machine of claim 1, wherein the liquid detergent mixing unit further comprises:

a wash water outlet pipe connected to the tub.

3. The washing machine of claim 1, wherein the liquid detergent mixing unit further comprises:

a vent pipe disposed on the one side surface of the main body to discharge air out of the mixing space.

4. The washing machine of claim 3, wherein a center of the vent pipe is disposed under a center of the wash water inlet pipe.

5. The washing machine of claim 1, wherein the wash water dispersing unit is configured such that an end surface of the wash water dispersing unit contacting the one end of the wash water inlet pipe has an inclined surface.

6. The washing machine of claim 5, wherein the end surface of the one end of the wash water inlet pipe inclines corresponding to the end surface of the wash water dispersing unit.

7. The washing machine of claim 1, wherein the one end of the wash water inlet pipe is configured such that a circumference thereof protrudes except a portion where the nozzle is formed so as to surround a portion of a circumference of the wash water dispersing unit.

8. The washing machine of claim 1, wherein the wash water dispersing unit is tapered toward the wash water inlet pipe.

9. The washing machine of claim 1, wherein the wash water dispersing unit has an end surface, a circumference of which protrudes so as to surround a portion of a circumference of the one end of the wash water inlet pipe except a portion where the nozzle is formed.

10. The washing machine of claim 9, wherein the one end of the wash water inlet pipe is tapered toward the wash water dispersing unit.

11. A liquid detergent mixer, comprising:

a main body defining a mixing space in which wash water and liquid detergent are mixed;

a detergent inlet pipe disposed on one side surface of the main body to allow liquid detergent to flow into the mixing space;

a wash water inlet pipe disposed on an opposite side surface of the main body, wherein the opposite side surface is opposite to the one side surface of the main body, having one end protruding from the opposite side surface of the main body to the mixing space to allow wash water to flow into the mixing space, and having a nozzle at a lower side of the one end thereof to allow wash water to flow into the mixing space; and a wash water dispersing unit disposed in the mixing space and having one end protruding from the one side surface of the main body and an other end contacted with the one end of the wash water inlet pipe in the mixing space to allow wash water to be dispersed in a downward direction through the nozzle, wherein an outlet of the wash water dispersing unit is opposite to an outlet of the detergent inlet pipe.

12. The liquid detergent mixer of claim 11, further comprising:

a wash water outlet pipe to discharge wash water mixed with liquid detergent out of the mixing space.

13. The liquid detergent mixer of claim 12, wherein the main body has a portion of an undersurface thereof inclined such that wash water mixed with liquid detergent flows into the wash water outlet pipe.

14. The liquid detergent mixer of claim 11, further comprising:

a vent pipe disposed on the one side surface of the main body to discharge air out of the mixing space.

* * * * *